US009650225B2

(12) United States Patent
Salmikuukka et al.

(10) Patent No.: US 9,650,225 B2
(45) Date of Patent: May 16, 2017

(54) ELEVATOR SYSTEM CONFIGURED TO ALLOCATE ONE OR MORE ELEVATORS TO A PASSENGER GROUP AND METHOD OF PERFORMING SAME

(71) Applicants: Jukka Salmikuukka, Espoo (FI); Eeva Lempinen, Shanghai (CN)

(72) Inventors: Jukka Salmikuukka, Espoo (FI); Eeva Lempinen, Shanghai (CN)

(73) Assignee: Kone Corporation, Helsinki (FI)

( * ) Notice: Subject to any disclaimer, the term of this patent is extended or adjusted under 35 U.S.C. 154(b) by 446 days.

(21) Appl. No.: 14/265,708

(22) Filed: Apr. 30, 2014

(65) Prior Publication Data

US 2014/0231185 A1 Aug. 21, 2014

Related U.S. Application Data

(63) Continuation of application No. PCT/FI2012/051101, filed on Nov. 12, 2012.

(30) Foreign Application Priority Data

Nov. 23, 2011 (FI) ..... 20116170

(51) Int. Cl.
*B66B 1/20* (2006.01)
*B66B 1/24* (2006.01)
*B66B 1/46* (2006.01)

(52) U.S. Cl.
CPC ..... *B66B 1/2408* (2013.01); *B66B 1/2458* (2013.01); *B66B 1/468* (2013.01);
(Continued)

(58) Field of Classification Search
CPC ..... B66B 2201/103; B66B 2201/40; B66B 2201/405; B66B 2201/4615;
(Continued)

(56) References Cited

U.S. PATENT DOCUMENTS 6,209,685 B1 4/2001 Zaharia et al.
6,707,374 B1 * 3/2004 Zaharia ..... B66B 1/468 187/392
(Continued)

FOREIGN PATENT DOCUMENTS

CN 101516759 A 8/2009
CN 101980943 A 2/2011
(Continued)

OTHER PUBLICATIONS

Chinese Office Action dated Apr. 3, 2015 issued in corresponding Chinese Application No. 201280057454.1 (with English translation).
(Continued)

*Primary Examiner* — Anthony Salata
(74) *Attorney, Agent, or Firm* — Harness, Dickey & Pierce, P.L.C.

(57) ABSTRACT

A method for allocating elevators including reading, via one or more reading devices, identification data from one or more access cards associated with passengers until a desired termination condition is fulfilled; forming a passenger group based on the identification data such that the passenger group is formed only if the reading reads the identification data associated with two or more of the passengers, the passenger group containing the passengers therein; registering one or more destination calls to the passenger group, the one or more destination calls having at least one or more destination floors associated therewith; and allocating one or more of a plurality of elevators to the passenger group to transport the passengers belonging to the passenger group from a departure floor to the one or more destination floors.

23 Claims, 2 Drawing Sheets

Figure 1:
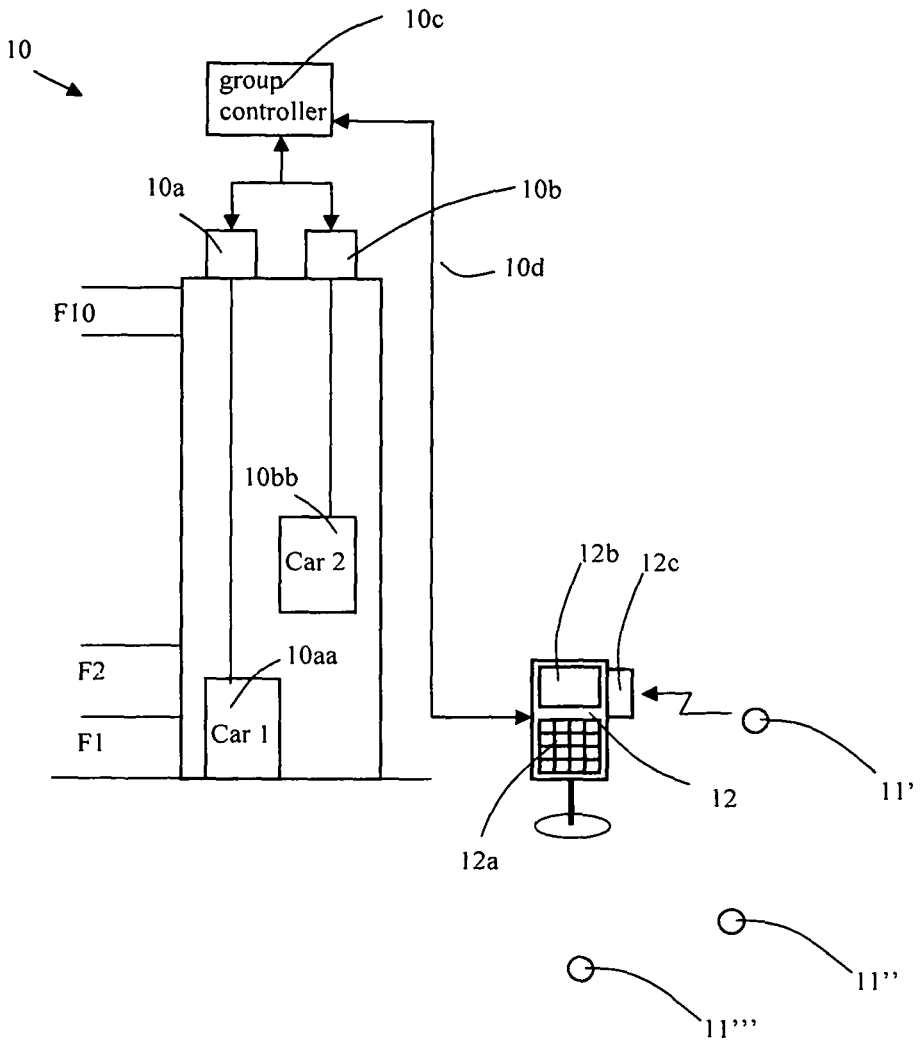

(52) U.S. Cl.
CPC ..... *B66B 2201/103* (2013.01); *B66B 2201/40* (2013.01); *B66B 2201/405* (2013.01); *B66B 2201/463* (2013.01); *B66B 2201/4615* (2013.01); *B66B 2201/4653* (2013.01); *B66B 2201/4676* (2013.01)

(58) Field of Classification Search
CPC ..... B66B 2201/463; B66B 2201/4653; B66B 2201/4676; B66B 1/2408; B66B 1/2458; B66B 1/468; B66B 1/20
USPC ..... 187/247, 380–388, 391, 392, 393
See application file for complete search history.

(56) References Cited

U.S. PATENT DOCUMENTS

| | | | | |
|---|---|---|---|---|
| 7,036,635 | B2 * | 5/2006 | Rintala | B66B 1/20 187/391 |
| 7,190,256 | B2 * | 3/2007 | Pieper | B66B 1/468 340/5.2 |
| 7,281,610 | B2 * | 10/2007 | Ylinen | B66B 1/462 187/382 |
| 7,921,968 | B2 * | 4/2011 | Stanley | B66B 1/20 187/383 |
| 8,505,692 | B2 * | 8/2013 | Tokura | B66B 3/006 187/382 |
| 8,646,581 | B2 * | 2/2014 | Iwata | B66B 1/468 187/387 |
| 8,770,350 | B2 * | 7/2014 | Wilke | B66B 1/468 187/247 |
| 8,813,917 | B2 * | 8/2014 | Salmikuukka | B66B 1/468 187/247 |
| 9,033,112 | B2 * | 5/2015 | Koba | B66B 1/2458 187/247 |
| 9,156,653 | B2 * | 10/2015 | Flynn | B66B 1/468 |
| 9,296,588 | B2 * | 3/2016 | Christy | B66B 1/2408 |
| 2004/0144599 | A1 | 7/2004 | Wyss et al. | |
| 2008/0041669 | A1 * | 2/2008 | Sansevero | B66B 3/00 187/389 |
| 2008/0245618 | A1 | 10/2008 | Stanley et al. | |
| 2010/0175953 | A1 | 7/2010 | Kostka | |
| 2010/0294600 | A1 | 11/2010 | Christy et al. | |
| 2011/0155514 | A1 | 6/2011 | Iwata et al. | |
| 2011/0214948 | A1 | 9/2011 | Suihkonen et al. | |
| 2016/0251198 | A1 * | 9/2016 | Salmikuukka | B66B 1/2458 |

FOREIGN PATENT DOCUMENTS

| | | | |
|---|---|---|---|
| CN | 102159484 | A | 8/2011 |
| CN | 102849547 | A | 1/2013 |
| WO | WO-00/75062 | A1 | 12/2000 |
| WO | WO-2006101553 | A2 | 9/2006 |
| WO | WO-2007061422 | A1 | 5/2007 |
| WO | WO-2008040836 | A1 | 4/2008 |
| WO | WO-2009047382 | A1 | 4/2009 |
| WO | WO-2009122002 | A1 | 10/2009 |
| WO | WO-2009123602 | A1 | 10/2009 |
| WO | WO-2010046522 | A1 | 4/2010 |

OTHER PUBLICATIONS

Extended European Search Report dated Jun. 8, 2015 issued in corresponding European Application No. 12850814.0.
International Search Report for PCT/FI2012/051101 dated Dec. 12, 2012.
Written Opinion for PCT/FI2012/051101 dated Dec. 12, 2012.
Finnish Search Report issued by Patent Office in Finland dated Apr. 3, 2012.

* cited by examiner

ELEVATOR SYSTEM CONFIGURED TO ALLOCATE ONE OR MORE ELEVATORS TO A PASSENGER GROUP AND METHOD OF PERFORMING SAME

This application is a continuation of PCT International Application No. PCT/FI2012/051101 which has an International filing date of Nov. 12, 2012, and which claims priority to Finnish patent application number 20116170 filed Nov. 23, 2011, the entire contents of both which are incorporated herein by reference.

FIELD OF THE INVENTION

The invention relates to elevator systems. More particularly the invention relates to the allocation of elevators to passenger groups in an elevator system.

BACKGROUND OF THE INVENTION

Known in the art is a call-giving method regarding elevator systems wherein a passenger indicates his/her destination floor already before going into the elevator car by giving a so-called destination call in the elevator lobby. A destination call is generally given either by the aid of a destination call panel in the elevator lobby or by the aid of a personal call-giving device. A personal call-giving device is e.g. an electronically readable ID card or a terminal suited to giving a call. A terminal device is e.g. a mobile phone or a means of communication comparable to it, by the aid of which a passenger can send a destination call to the elevator system by radio. An ID card is e.g. an identifier based on the RFID technology, the data stored in which identifier can be read e.g. with a reader device in the elevator lobby and can be registered as a destination call on the basis of the data read. In conventional destination call systems each passenger must give a destination call to the floor to which he/she is traveling. Also known in the art are destination call systems wherein a passenger can indicate, in addition to the destination floor, also the number of passengers (a so-called group call) traveling along with him/her (in a group). In this case the elevator system allocates one elevator car to the whole group, if the group is sufficiently small to fit into the same elevator car and if the traffic situation of the elevator system permits the allocation in question. The group call described above is, however, problematic because it allows, among other things, misuse and even malicious damage in call-giving such that a passenger moving alone gives a group call to receive for his/her use a "roomy" elevator car. As a consequence of gratuitous group calls, the transport capacity of the elevator system can decrease significantly, which is problematic particularly during a time of upward peak traffic because the arrival of passengers at their destinations is delayed and elevator lobbies can become congested. Another problem is that all the passengers belonging to a group must go to the same destination floor and also that an inspection of the access rights of passengers belonging to the group is not connected to the giving of a call.

AIM OF THE INVENTION

The aim of the present invention is to disclose a solution, which eliminates or at least alleviates the drawbacks occurring in prior-art solutions presented above. The aim of the invention is also to achieve one or more of the following advantages:

- to improve access control in buildings,
- to facilitate the formation (configuration) of passenger groups, and
- to facilitate and speed up the giving of group calls.

SUMMARY OF THE INVENTION

The method according to the invention is characterized by what is disclosed in the characterization part of claim 1. The elevator system according to the invention is characterized by what is presented in the characterization part of claim 14. Other embodiments of the invention are characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the scope of the basic inventive concept in conjunction with other embodiments.

The present invention discloses a method for allocating an elevator for the use of a passenger group in an elevator system, which comprises a number of elevators, call-giving devices for registering destination calls given by passengers, and reader devices for reading the access cards given into the possession of passengers. According to the invention the identification data contained in at least one access card, or in a number of access cards read with the same reader device, is read until the desired termination condition is fulfilled. On the basis of the identification data a passenger group is formed, one or more destination calls connected to the passenger group are registered, and an elevator is allocated for taking the passengers belonging to the passenger group from the departure floor according to the registered destination calls to one or more destination floors.

The present invention also discloses an elevator system, which comprises a plurality of elevators, call-giving devices for registering destination calls given by passengers, reader devices for reading the access cards given into the possession of passengers and also a control system of the elevator system, which control system is connected via a data transfer connection to the aforementioned call-giving devices and also to the reader devices. According to the invention the control system is arranged to read the identification data of one or more access cards with reader devices, to form a passenger group on the basis of the identification data, which identification data is read with the same reader device until the desired termination condition is fulfilled, to register one or more destination calls to be connected to the passenger group and to allocate for the use of the passenger group an elevator for taking the passengers belonging to the passenger group from the departure floor according to the destination calls to one or more destination floors.

The term call-giving device refers to any device whatsoever suited to the giving of destination calls, such as e.g. a destination call panel disposed in an elevator lobby or a personal terminal device suited to the giving of destination calls.

The term access card refers in this context to any ID card, identifier, terminal device or other corresponding personal means whatsoever, having identification data recorded in it that can be read with a reader device suited to the purpose.

An access card is e.g. a personal RFID identifier or terminal device, intended for access control use, comprising e.g. pushbuttons and a display for giving destination calls to an elevator system.

A termination condition is fulfilled when a passenger belonging to a passenger group gives manually with a call-giving device. A termination condition can also be fulfilled when/if none of the passengers of a passenger group gives a manual destination call inside a predefined time window starting from when the identification data of the last access card was read by a certain reader device. When the termination condition is fulfilled, a passenger group can be formed. In this case on the basis of the identification data the data to be connected to the passenger group is determined, e.g. the number of passengers belonging to the passenger group and/or the passenger-specific access rights in the building are determined.

In one embodiment of the invention group data is connected to the identification data of the access cards, on the basis of which group data passengers can be automatically connected to the same passenger group. Group data is configured e.g. by taking access cards into close range of each other and by sending configuration messages between the access cards. The access cards generate the configuration messages either automatically or when passengers press a predetermined pushbutton on the access card. Group data is recorded in one or more access cards and/or in the control system of the elevator system. Preferably the group data is recorded in the access card of each passenger of a passenger group. In order for the access cards to be able to send configuration messages to each other, they must be provided with means suited to near-field communication.

Group data is either static group data or dynamic group data. Static group data is permanent data, in which case the passengers having the same group data are always connected to the same passenger group. Dynamic group data is valid only for the time of one group trip, in which case passengers must configure the group data again before the next group trip.

In one embodiment of the invention the access cards are read by taking them consecutively to the same reader device inside a given time window. When the time according to the time window is exceeded or a destination call is keyed in from a destination call panel in connection with a reader device, a passenger group is formed on the basis of the identification data read from consecutive access cards.

Destination calls to be connected to a passenger group can be given from a destination call panel as consecutive destination calls inside a certain time window after the last access card belonging to a passenger group has been read in the manner described above. If not a single destination call to be connected to the passenger group is given from the destination call panel, alternatively the destination calls in which, on the basis of the identification data, the destination floor is the determined passenger-specific default floor can be registered. As a result of the embodiment passenger groups are easy to form and a number of destination floors, to which the passengers belonging to the passenger group are taken with the elevator, can easily be connected to a group trip.

In one embodiment of the invention on the basis of the identification data the access rights in the building of the passengers belonging to a passenger group are determined and only those destination calls for which all passengers of the passenger group have an access right are registered. As a result of the embodiment, access control can be improved in a building because passengers cannot gain access along with a passenger group to floors for which they have no access right.

When a passenger group has been formed and the destination calls to be connected to it have been registered, an elevator from the elevator system is allocated for the use of the passenger group. At question here is a group call, which determines at least the number of passengers belonging to the group and also the destination floors to which the passengers are going. The elevator allocated is notified to the passengers belonging to the passenger group e.g. with a display in connection with a destination call panel. When the allocated elevator arrives at the floor from which the group call was received, the passengers belonging to the passenger group transfer into the elevator car of the elevator in question, which takes them to the floors according to the registered destination calls.

With the solution according to the invention numerous advantages are achieved compared to prior-art solutions. Passengers can easily form passenger groups by taking their access cards into close range of each other. The passengers belonging to a group can travel to different destination floors, which gives passengers freedom of choice in forming groups. In forming groups the access cards of the access control and the identification data recorded in them can be utilized. As a result of the invention access control can be improved by preventing the access of passengers along with a passenger group to floors for which they have no access right.

LIST OF FIGURES

In the following, the invention will be described in detail by the aid of a few examples of its embodiments, wherein:

FIG. 1 presents one elevator system according to the invention, and

Figure 2:
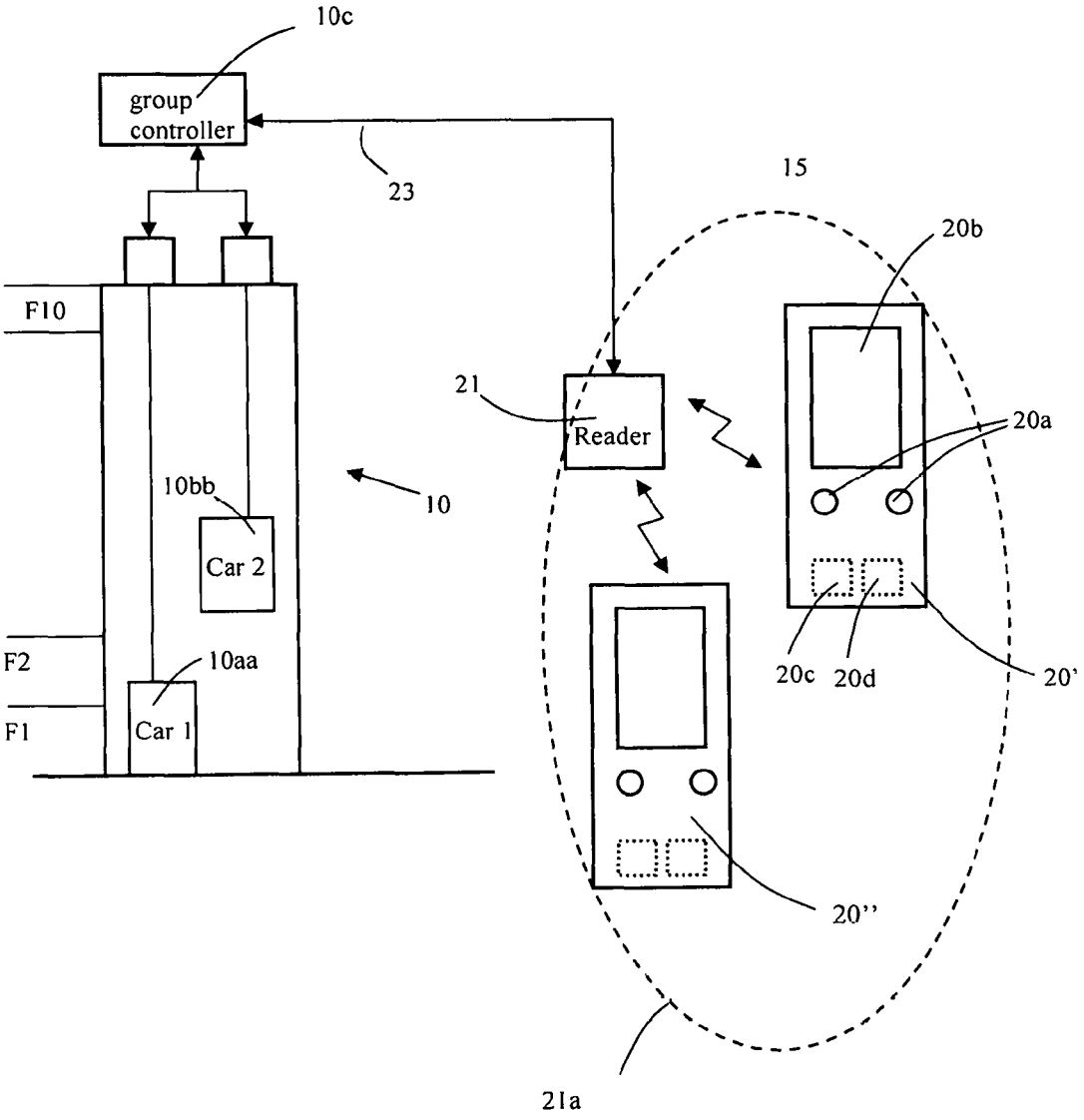

FIG. 2 presents a second elevator system according to the invention.

DETAILED DESCRIPTION OF THE INVENTION

FIG. 1 presents one elevator system 10 according to the invention. The elevator system 10 forms an elevator group, which comprises two elevators 10*a*, 10*b*, the elevator cars 10*aa*, 10*bb* of which move in the elevator hoistway between the floors F1, F2 . . . F10. In the elevator lobbies of the floors F1, F2 . . . F10 are destination call panels 12, of which FIG. 1 presents only the destination call panel of floor F1 (entrance lobby). The destination call panels 12 are connected via a data transfer connection suited to the purpose, e.g. via a fieldbus 10*d*, to the control system 10*c* of the elevator group 10 (the group control) for transmitting data between the group control and the destination call panels 12. A destination call panel comprises a display 12*b*, call-giving pushbuttons 12*a* and also a reader device 12*c*. Passengers have been given personal access cards 11 (11', 11" and 11'"), which are e.g. passive RFID identifiers, and they contain an individual identification code (ID code). The identification code can be read with a reader device 12*c*, when the access card 11 is taken to the reader device 12*c*. For taking an access card to a reader device, it is sufficient that it is taken into the operating range of the reader device 12*c*, which extends e.g. to a few centimeters from the reader device 12*c*.

In the following the invention will be described with the aid of an example.

Three people, who want to travel in the same elevator car to floor F5, arrive in the entrance lobby F1. Each person has in his/her possession an access card 11 (11', 11", 11'"). The first person takes his/her access card 11' to the reader device 12*c* without giving a destination call with the pushbuttons 12*a* of the destination call panel. Also the next person belonging to the passenger group takes his/her access card 11" to the reader device 12*c* without giving a destination call with the pushbuttons 12*a*. The third person belonging to the passenger group takes his/her access card 11'" to the reader device 12*c* and gives a destination call to floor F5 with the pushbuttons 12*a*. The identification data contained in all three access cards 11', 11'" and 11'" is transmitted consecutively from the reader device 12*c* to the group control 10*c* as also the manual destination call given by the third passenger with the pushbuttons 12*a*. Since the access cards of all three passengers were read consecutively with the same reader device 12*c* and only the third passenger gave a manual destination call, the group control 10*c* forms a passenger group of three passengers and connects to it a destination call from the entrance lobby F1 to floor F5. The group control 10*c* allocates an elevator for the use of the passenger group and informs about the elevator allocated with the display 12*b* of the destination call panel. If, as an exception from the above example, the people are traveling to different floors, e.g. to floor F4 and F5, the third passenger can register destination calls consecutively to floors F4 and F5 with the pushbuttons 12*a* inside a predetermined time window. If the time window is e.g. three seconds, the third person must first give a destination call to floor F5 and within three seconds after that a destination call to floor F4 (or first to floor F4 and after that to floor F5). The group control registers the aforementioned destination calls and connects them to the passenger group formed. The group control allocates to the passenger group the optimal elevator for taking the people belonging to the passenger group from the entrance lobby F1 to floors F4 and F5. The number of passengers belonging to the passenger group and the destination floors to which the people belonging to the passenger group must be taken can be taken into account in the optimization. If, e.g. owing to the traffic situation, there are no elevators in the elevator system with which the passengers of the group could be served, the elevator system can request the people of the passenger group to give destination calls in the normal manner and can allocate a number of elevators for the use of the group.

In the embodiments presented above, the last passenger belonging to a passenger group gives one or more destination calls with the pushbuttons 12*a*. If the group control ascertains that not a single destination call was given with the pushbuttons 12*a* within the predefined time window after the last passenger of the passenger group took his/her access card to the reader device 12*c*, the group control 10*c* determines on the basis of the identification data the default floors of the passengers belonging to the group and registers destination calls to the floors in question. The default floor is e.g. the floor on which a person works.

FIG. 2 presents a second elevator system, wherein passengers have a terminal device 20 (20', 20") in use. The terminal device 20 comprises a plurality of pushbuttons 20*a* for giving destination calls and other necessary operating commands. The terminal device further comprises a display 20*b*, on which can be presented e.g. information relating to the giving of a call. A transponder 20*c* is integrated into the terminal device for transmitting data between the terminal device and a reader device 21 by radio. The transponder 20*c* is e.g. an active RFID identifier, which comprises an antenna, a memory, a processor unit, and also connection electronics for reading the status data of the pushbuttons 20*a* and for formatting the information to be presented with the display 20*b*. A reader device 21, which is connected via a local area network 23 to the group control 10*a* of the elevator group, is able to receive and to send data from the transponder/to the transponder 20*c*. The operating range 21*a* of the reader device 21 covers e.g. the entrance lobby F1.

In the following the invention will be described in the light of a second example in an elevator system according to FIG. 2. In addition to an individual ID code, group data is also connected to the identification data of the terminal devices 20, which group data the group control 10*c* uses for forming passenger groups. Group data is e.g. a list of the ID codes of those terminal devices that belong to the same passenger group. Alternatively the group data can be information identifying a passenger group (a so-called group ID), which is the same for all passengers belonging to the group. Two people, who have in their possession a personal terminal device 20 (20', 20"), want to travel together from the entrance lobby F1 to floor F5. The ID codes of the terminal devices are recorded in the terminal devices of the people as group data. When the people arrive in the entrance lobby F1, the reader device 21 monitoring the entrance lobby reads the identification data of both terminal devices 20', 20" and transmits the identification data together with the group data to the group control 10*a*. The reading distance can in this case be a few meters, if necessary even tens of meters. The first person belonging to the passenger group gives with his/her terminal device 20' a destination call to floor F5. The destination call is transmitted via the reader device 21 to the group control 10*c*, which forms a passenger group of two people because the people are simultaneously in the operating range 21*a* of the reader device 21 and the same group data (the FIG. 100) is in the identification data read from the terminal devices of the people. The group control allocates to the passenger group an elevator for traveling to floor F5. When the elevator has been allocated, the group control sends via the reader device 21 to the terminal devices 20', 20" information about the elevator allocated. The information about the elevator allocated is shown on the display 20*b* of the terminal devices, e.g. with the text "Go to elevator A". Before the arrival of the allocated elevator at the entrance lobby F1, the second passenger belonging to the passenger group can give a destination call with his/her terminal device 20", if he/she is going to some other floor than the destination floor F5 given by the first passenger.

The group data is configured by taking the terminal devices of the passengers belonging to the group into the close range of each other, in which case the terminal devices read each other's identification data, e.g. the ID codes of the terminal devices taken into close range. At least one of the aforementioned terminal devices records the ID codes as group data in the internal memory of the terminal device and/or sends it to the group control for recording as group data in the memory of the group control 10*a*. Close range in this context means a distance, which is e.g. approx. 0.2 meters, or a distance shorter than that. Configuration of group data can occur automatically such that the users of terminal devices do not need to do anything other than take the terminal devices into the aforementioned close range of each other. For preventing unintentional configuration of group data, a confirmation can be requested from the users of terminal devices as to whether he/she wants to belong to the group being configured, e.g. he/she must press the "OK" button on the terminal device.

The transmission of ID codes between terminal devices can occur e.g. via the transponders 20*c*. It is also possible to provide terminal devices with special communications means 20*d* suited to near-field communication, which means are used primarily for configuring group data when the terminal devices are in close range of each other. The communications means in question can be based on e.g. RFID, NFC, infrared or some other corresponding technology.

Group data can be either dynamic group data or static group data. Dynamic group data is valid only for a certain maximum time or during only one group trip and as a result of that the data must always be configured again when it is desired to make a new group trip. Static group data is permanent group data and it is sufficient that the data is configured once. For example, all the employees of the same company can be configured permanently into the same passenger group. If two or more employees of the company are identified at the same time in the same elevator lobby, the group control can automatically form a passenger group on the basis of the aforementioned group data.

In one embodiment of the invention the group control determines on the basis of identification data the access rights in a building of each passenger belonging to the passenger group and determines those floors to which all the passengers participating in a group trip have an access right. When the passengers participating in a group trip give destination calls, the group control registers only the destination calls to the "common floors" in question. With the application the access of unauthorized persons along with a passenger group to floors for which they have no access right is prevented.

The invention is not only limited to be applied to the embodiments described above, but instead many variations are possible within the scope of the inventive concept defined by the claims below. Thus, for example, the control system of the elevator system can comprise a number of separate control units, of which one or more control unit can belong to the access control system of the building.

The invention claimed is:

1. A method of allocating one or more of a plurality of elevators in an elevator system to a passenger group, the elevator system including the plurality of elevators, call-giving devices and one or more reading devices, the method comprising:

reading, via the one or more reading devices, identification data from one or more access cards associated with passengers until a desired termination condition is fulfilled;

forming a passenger group based on the identification data such that the passenger group is formed only if the reading reads the identification data associated with two or more of the passengers, the passenger group containing the passengers therein;

registering one or more destination calls to the passenger group, the one or more destination calls having at least one or more destination floors associated therewith; and allocating the one or more of the plurality of elevators to the passenger group to transport the passengers belonging to the passenger group from a departure floor to the one or more destination floors.

2. The method according to claim 1, wherein the method further comprises:

connecting group data to the identification data of the one or more access cards; and forming the passenger group based on the group data.

3. The method according to claim 2, wherein the reading includes reading two or more access cards in close range of each other, and the forming the passenger group includes generating the group data based on the identification data of the two or more access cards, and linking the group data to the identification data.

4. The method according to claim 2, further comprising:

deleting the group data automatically after the passengers in the passenger group are transported to the one or more destination floors group.

5. The method according to claim 1, wherein at least one of the call-giving devices is a destination call panel in an elevator lobby of the departure floor.

6. The method according to claim 5, wherein the reading includes reading, via the one or more reading devices, the identification data from consecutive access cards until a last one of the passengers belonging to the passenger group registers the at least one destination call via pushbuttons of the destination call panel or until a threshold period of time has passed from the reading of a last one of the consecutive access cards.

7. The method according to claim 6, wherein the registering includes registering the destination call given by the last one of the passengers to the passenger group, and registering any consecutive destination calls following the destination call given by the last one of the passengers to the passenger group, if the consecutive destination calls are given with the pushbuttons within a given time window.

8. The method according to claim 6, further comprising:

displaying, via the destination call panel, which of the plurality of elevators is allocated to the passenger group.

9. The method according to claim 1, wherein at least one of the call-giving devices are terminal devices associated with respective ones of the passengers.

10. The method according to claim 9, wherein at least one of the one or more reading devices are configured to monitor an elevator lobby associated with the departure floor, and the reading reads the identification data from the terminal devices associated with the passengers who are simultaneously in the elevator lobby.

11. The method according to claim 9, wherein the registering includes receiving the one or more destination calls from the terminal devices associated with the passengers belonging to the passenger group before the one or more elevators allocated to the passenger group arrive at the departure floor.

12. The method according to claim 1, further comprising:

transmitting an announcement to the terminal devices, the announcement indicating which of the plurality of elevators is allocated to the passenger group.

13. The method according to claim 1, further comprising:

determining access rights of the passengers belonging to the passenger group based on the identification data read from access cards, wherein the registering only registers ones of the one or more destination calls having associated destination floors which all of the passengers of the passenger group have credentials to access based on the access rights.

14. An elevator system, comprising:

a plurality of elevators;

call-giving devices configured to register one or more destination calls given by passengers, one or more reading devices configured to read one or more access cards associated with the passengers; and a controller connected to the call-giving devices and to the reader devices, the controller configured to, read, via the one or more reading devices, the identification data from the one or more access cards until a desired termination condition is fulfilled, form a passenger group based on the identification data such that the controller is configured to form the passenger group only if the controller reads the identification data associated with two or more of the passengers, register the one or more destination calls to the passenger group, the one or more destination calls having at least one or more destination floors associated therewith; and allocate one or more of the plurality of elevators to the passenger group to transport the passengers belonging to the passenger group from a departure floor to the one or more destination floors.

15. The elevator system according to claim 14, wherein the controller is configured to, connect group data to the identification data of the one or more access cards, and forming the passenger group based on the group data.

16. The elevator system according to claim 14, wherein at least one of the one or more access cards includes a client-side reading device configured to read the identification data of the one or more access cards in close range thereto, and to form group data based on the identification data.

17. The elevator system according to claim 15, wherein the group data is recorded in at least one of the one or more access card a memory associated with the controller.

18. The elevator system according to claim 14, wherein the controller is configured to read, via the one or more reading devices, the identification data from consecutive access cards until the controller registers the at least one destination call given via pushbuttons of a destination call panel or until a threshold period of time has passed from the controller reading a last one of the consecutive access cards.

19. The elevator system according to claim 14, wherein at least one of the one or more reading devices are configured to monitor an elevator lobby associated with the departure floor, and the controller is configured to read, via the at least one of the one or more reading devices, the identification data from the terminal devices associated with the passengers who are simultaneously in the elevator lobby.

20. The elevator system according to claim 19, wherein the controller is configured to register the one or more destination calls by, receiving the one or more destination calls from the terminal devices associated with the passengers belonging to the passenger group before the one or more elevators allocated to the passenger group arrive at the departure floor.

21. The elevator system according to claim 14, wherein the controller is configured to display, via the destination call panel or a terminal device, which of the plurality of elevators is allocated to the passenger group with a display in connection with a destination call panel or with a display in connection with a terminal device.

22. Elevator system according to claim 14, wherein the control system is arranged to determine the access rights of all the passengers belonging to a passenger group on the basis of the identification data read from access cards and to connect to the data of the passenger group only those destination calls to a destination floor designated by which destination calls all passengers of the passenger group have an access right.

23. An elevator controller comprising:

a memory and a processor, the memory containing computer readable code that, when executed by the processor, configures the processor to, read, via one or more reading devices, identification data from one or more access cards associated with passengers until a desired termination condition is fulfilled, form a passenger group based on the identification data, the passenger group containing the passengers therein such that the controller is configured to form the passenger group only if the controller reads the identification data associated with two or more of the passengers, registering one or more destination calls to the passenger group, the one or more destination calls having at least one or more destination floors associated therewith, and allocating one or more of a plurality of elevators to the passenger group to transport the passengers belonging to the passenger group from a departure floor to the one or more destination floors.

* * * * *